US007466799B2

(12) United States Patent
Miller

(10) Patent No.: US 7,466,799 B2
(45) Date of Patent: Dec. 16, 2008

(54) X-RAY TUBE HAVING AN INTERNAL RADIATION SHIELD

(75) Inventor: Robert Steven Miller, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 10/409,854

(22) Filed: Apr. 9, 2003

(65) Prior Publication Data

US 2004/0202282 A1 Oct. 14, 2004

(51) Int. Cl.
*H01J 35/16* (2006.01)

(52) U.S. Cl. ..... 378/140; 378/121; 378/203

(58) Field of Classification Search ..... 378/121, 378/136–140, 143, 203
See application file for complete search history.

(56) References Cited

U.S. PATENT DOCUMENTS 3,679,927 A * 7/1972 Kirkendall ..... 378/137
4,184,097 A 1/1980 Auge
4,573,186 A * 2/1986 Reinhold ..... 378/138
4,588,493 A * 5/1986 Blumenthal et al. ..... 204/410
4,679,219 A * 7/1987 Ozaki ..... 378/121
4,771,447 A * 9/1988 Saitoh et al. ..... 378/119
5,031,200 A * 7/1991 Plessis et al. ..... 378/136
5,563,923 A * 10/1996 Okada et al. ..... 378/138
5,617,464 A * 4/1997 Mika et al. ..... 378/137
5,680,433 A * 10/1997 Jensen ..... 378/141
5,751,784 A * 5/1998 Enck ..... 378/140
5,780,164 A * 7/1998 Pyzik et al. ..... 428/539.5
5,857,008 A * 1/1999 Reinhold ..... 378/137
6,030,681 A * 2/2000 Czubarow et al. ..... 428/846.2
6,229,876 B1 * 5/2001 Enck et al. ..... 378/136
6,282,262 B1 * 8/2001 Warburton ..... 378/119
6,327,328 B1 * 12/2001 Satoh et al. ..... 378/17
6,381,305 B1 * 4/2002 Okada et al. ..... 378/137
6,385,294 B2 * 5/2002 Suzuki et al. ..... 378/136
6,526,122 B2 * 2/2003 Matsushita et al. ..... 378/138
6,674,838 B1 * 1/2004 Barrett ..... 378/125
6,830,827 B2 * 12/2004 Narita et al. ..... 428/661

OTHER PUBLICATIONS

Henry M. Jackson Foundation and Michael D. Dullea, MD, "How X-Rays Are Made," 2000, website: http://rad.usuhs.mil.

* cited by examiner

*Primary Examiner*—Allen C. Ho
(74) *Attorney, Agent, or Firm*—Workman Nydegger

(57) ABSTRACT

A shielding disk for managing x-ray emission form a stationary anode x-ray tube is disclosed. The stationary anode x-ray tube includes an anode housing and a stainless steel can that together form an evacuated enclosure and respectively contain a stationary anode and a cathode assembly. The shielding disk, comprised of tungsten, is interposed between the anode housing and the can, and is formed with a region, such as a hole, formed through a central portion thereof. During tube operation, electrons pass through the shielding disk hole to impact a target surface on the anode and produce x-rays. Those x-rays that do not pass through a window defined in the anode housing to exit the tube but instead emanate toward the can, are intercepted and absorbed by the shielding disk before entering the can. This results in a reduced need for lead shielding disposed about external surfaces of the x-ray tube.

28 Claims, 4 Drawing Sheets

X-RAY TUBE HAVING AN INTERNAL RADIATION SHIELD

BACKGROUND OF THE INVENTION

1. The Field of the Invention

The present invention generally relates to stationary anode x-ray tubes. In particular, the present invention relates to structures and methods for controlling the unintended emission of x-rays from certain regions of a stationary anode x-ray tube, thereby decreasing the need for external tube shielding.

2. The Related Technology

X-ray producing devices are extremely valuable tools that are used in a wide variety of applications, both industrial and medical. Such equipment is commonly used in applications such as diagnostic and therapeutic radiology, semiconductor fabrication, joint analysis, and non-destructive materials testing. While used in a number of different applications, the basic operation of an x-ray tube is similar. In general, x-rays are produced when electrons are accelerated and impinged upon a material of a particular composition.

An x-ray generating device typically includes a cathode having an electron source, and an anode disposed within an evacuated enclosure. The anode includes a target surface that is oriented to receive electrons emitted by the electron source. In operation, an electric current is applied to the electron source, such as a filament, which causes electrons to be produced by thermionic emission. The electrons are then accelerated towards the target surface of the anode by applying a high voltage potential between the cathode and the anode. Upon striking the anode target surface, some of the resulting kinetic energy is released as electromagnetic radiation of very high frequency, i.e., x-rays.

The specific frequency or wavelength of the x-rays produced depends in large part on the type of material used to form the anode target surface. Anode target surface materials with high atomic numbers ("Z" numbers), such as tungsten, are typically employed. The x-ray ultimately exit the x-ray tube through a window in the x-ray tube, and interact in or on a material sample, patient, or other object. As is well known, the x-rays can be used for sample analysis procedures, medical diagnostic and treatment, or various other applications.

Many x-ray tubes employ a rotary anode that rotates portions of its target surface into and out of the stream of electrons produced by the cathode filament. However, in other tubes a stationary anode is used. The anode in stationary anode x-ray tubes typically includes a substrate portion, comprised of copper or similar material, and a target surface comprised of rhodium, palladium, tungsten, or other suitable material. The target surface is angled toward the tube window to maximize the number of x-rays produced at the target surface that can exit the tube.

Notwithstanding the angled orientation of the stationary anode target surface, x-rays nonetheless emanate in all directions from the target surface after their production. Thus, while a portion of the x-rays does indeed pass through the window to exit the tube and be utilized as intended, a large number of x-rays do not. X-rays that do not pass through the window penetrate instead into other areas of the x-ray tube and can escape the tube if sufficient measures to prevent their escape are not taken. Escape of such non-window transmitted x-rays from the tube is highly undesired as they can represent a significant source of x-ray contamination to tube surroundings. For instance, users of an x-ray tube that emits undesired x-rays through non-window tube surfaces can receive relatively high doses of x-ray radiation, which can result in adverse health effects. In addition, such non-window transmitted x-rays can interfere with the primary x-ray stream that is properly transmitted through the window, causing reduced quality results. In x-ray imaging, for example, non-window transmitted x-rays from the x-ray tube can impinge upon areas of an object to be imaged and interfere with the image being sought. The interference caused by the impingement of the undesired x-rays is manifested as clouding in the image, thus reducing image quality.

Efforts to reduce the emission of x-rays from non-window portions of an x-ray tube have centered around the use of external shielding on tube structures. For instance, in many stationary anode tubes a layer of lead shielding is placed about the inner surface of an outer housing that contains the tube to absorb non-window transmitted x-rays that are produced at the target surface and penetrate the tube's evacuated enclosure.

Despite its utility in preventing undesired x-ray emission from the x-ray tube, lead linings nevertheless suffer from a number of challenges. Primary among these is the fact that, though effective at absorbing x-rays, lead is relatively heavy and substantially adds to the weight of the tube. This factor becomes important in applications where a relatively low tube weight is desired or even required. In addition, because the lead lining is placed relatively far away from the target surface of the anode (i.e., attached to the outer housing located beyond the outer surface of the evacuated enclosure), large amounts of lead must be used to cover relatively large portions of the enclosure surface to account for the radially expanding pattern of x-ray emission from the target surface. Indeed, nearly the entire surface area of the evacuated enclosure is covered by lead lining to prevent x-ray emission from the tube. The addition of lead linings described herein represents a significant cost in time and labor during x-ray tube manufacture.

It is further known that certain areas of the x-ray tube are especially susceptible to the impingement of non-window transmitted x-rays. These areas include one or more ports defined in the outer housing through which high voltage cables pass to provide a voltage potential for the cathode, anode, or both. In an anode grounded x-ray tube, for instance, a voltage supply is provided to the cathode via a high voltage cable that passes through a port defined in the outer housing and electrically connects with a portion of the cathode. Because of electrical insulation requirements between the cathode and the high voltage cable connection thereto, adequate x-ray shielding is difficult to attain near the port. Specifically, lead shielding, which is electrically conductive, cannot be disposed near the high voltage connection between the cable and the cathode so as to maintain the electrical isolation of the cathode. Thus, x-rays that would otherwise be absorbed by lead shielding are instead allowed to pass through the high voltage connection area and exit the port, thus providing a contamination point through which significant x-ray escape from the tube can occur. If left unchecked, this unintended x-ray emission can compromise tube performance and damage the near-tube environment. At the very least, this situation requires the placement of additional shielding around the tube to absorb any x-ray emission from the port, undesirably adding weight to the tube.

In light of the above discussion, a need exists in the art for a means by which unintended x-ray emission from an x-ray tube is prevented. Additionally, any such means should minimize the use of excessive, heavy external shielding that significantly adds to the (weight of the tube. Any solution to the above problems should additionally provide for a relatively light x-ray tube that enables its use in weight-sensitive applications.

BRIEF SUMMARY OF THE INVENTION

The present invention has been developed in response to the above and other needs in the art. Briefly summarized, embodiments of the present invention are directed to an x-rays tube having enhanced shielding characteristics that prevent the unintended emission of x-rays from the tube. Specifically, the present x-ray tube is configured so as to reduce or eliminate the escape of x-rays from regions of the tube where radiation shielding has been difficult to achieve. Such areas include ports defined in the vacuum enclosure of the tube through which high voltage cables connect with a cathode and/or anode that are disposed within the vacuum enclosure.

In one embodiment, the x-ray tube of the present invention includes an evacuated enclosure disposed within an outer housing. An anode housing, which contains an anode and target surface, and a cylindrical portion containing a cathode assembly are hermetically sealed to one another to form the evacuated enclosure. The cathode assembly includes a filament that serves as an electron source for producing electrons. During tube operation, electrons produced by the filament are accelerated toward the target surface of the anode via a passage defined between the anode housing and the cylindrical portion of the evacuated enclosure. The electrons impact a portion of the target surface and produce x-rays as a result of the collision. A portion of the x-rays then exits the x-ray tube through at least one x-ray transmissive window defined in the evacuated enclosure, the outer housing, or both.

In accordance with embodiments of the present invention, a radiation shielding component is integrated into the x-ray tube design within the evacuated enclosure to absorb a portion of those x-rays that are produced at the target surface but do not pass through the at least one x-ray transmissive window. In particular, the radiation shielding component is designed and configured to absorb x-rays having certain trajectories in order to prevent the impingement of x-rays on specified tube regions including, in one embodiment, a port defined in the outer housing through which a high voltage cable is passed to provide a voltage signal to the cathode assembly.

In the present embodiment, the radiation shielding component comprises a rounded shielding disk that is interposed between the cathode assembly and the anode target surface. Specifically, the shielding disk is placed in the junction between the anode housing and the cylindrical portion comprising the evacuated enclosure. The shielding disk defines a portion of the passage between the anode housing and the cylindrical portion via an aperture defined in the disk. The aperture defined in the shielding disk enables electrons from the cathode assembly filament to pass through the shielding disk in transit toward the target surface of the anode during x-ray production.

As mentioned, the shielding disk is positioned within the evacuated enclosure of the x-ray tube to prevent the impingement of x-rays on specified regions of the tube. During tube operation, the voltage differential existing between the cathode and the anode causes electrons emitted by the cathode assembly filament to be directed toward the target surface of the anode, which is disposed in the anode housing portion of the evacuated enclosure. In transit, the electrons pass from the cylindrical portion of the evacuated enclosure (housing the cathode assembly) to the anode housing through the passage and the aperture defined in the shielding disk. Upon arriving at and impinging on the target surface, the electrons cause a plurality of x-rays to be produced at the target surface. The x-rays radially emanate in various directions from the target surface in a hemispherical pattern. A portion of these x-rays are directed back toward the cylindrical portion of the evacuated enclosure. The shielding disk is positioned between the anode housing and the cylindrical portion to intercept and absorb these x-rays. So absorbed by the shielding disk, the x-rays are unable to escape from the x-ray tube, especially at the high voltage cable port.

The shielding disk of the present invention is preferably composed of tungsten and is disposed in close proximity to the target surface in order to intercept as many of the unintended x-rays as possible as they radiate from the target surface. The ability of the shielding disk to absorb a large number of x-rays near the target surface and within the evacuated enclosure correspondingly reduces the need for substantial amounts of lead shielding about the evacuated enclosure exterior, especially in areas proximate the high voltage cable port. This in turn reduces the overall weight of the tube, which not only lowers the cost of tube assembly, but also expands its utility into applications where lighter weight tubes are required.

The present shielding disk can be used in conjunction with other shielding schemes to substantially limit the unintended emission of x-rays from the x-ray tube. In one embodiment, a secondary shielding disk is positioned behind the cathode assembly filament to intercept and absorb x-rays that pass through the aperture of the primary shielding disk disposed in the passage, thereby providing even more complete x-ray absorption within the tube.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is understood that the drawings are diagrammatic and schematic representations of presently preferred embodiments of the invention, and are not limiting of the present invention nor are they necessarily drawn to scale.

FIGS. 1-4B depict various features of embodiments of the present invention, which is generally directed to an x-ray tube having one or more radiation shielding components positioned within the evacuated enclosure of the tube. The radiation shielding components are sized and positioned in relatively proximate relation to the target surface of the tube anode to intercept and absorb selected x-rays that radiate from the target surface, thereby reducing the amount of radiation shielding that is needed further away from the target surface, such as at points exterior to the evacuated enclosure.

Figure 1:
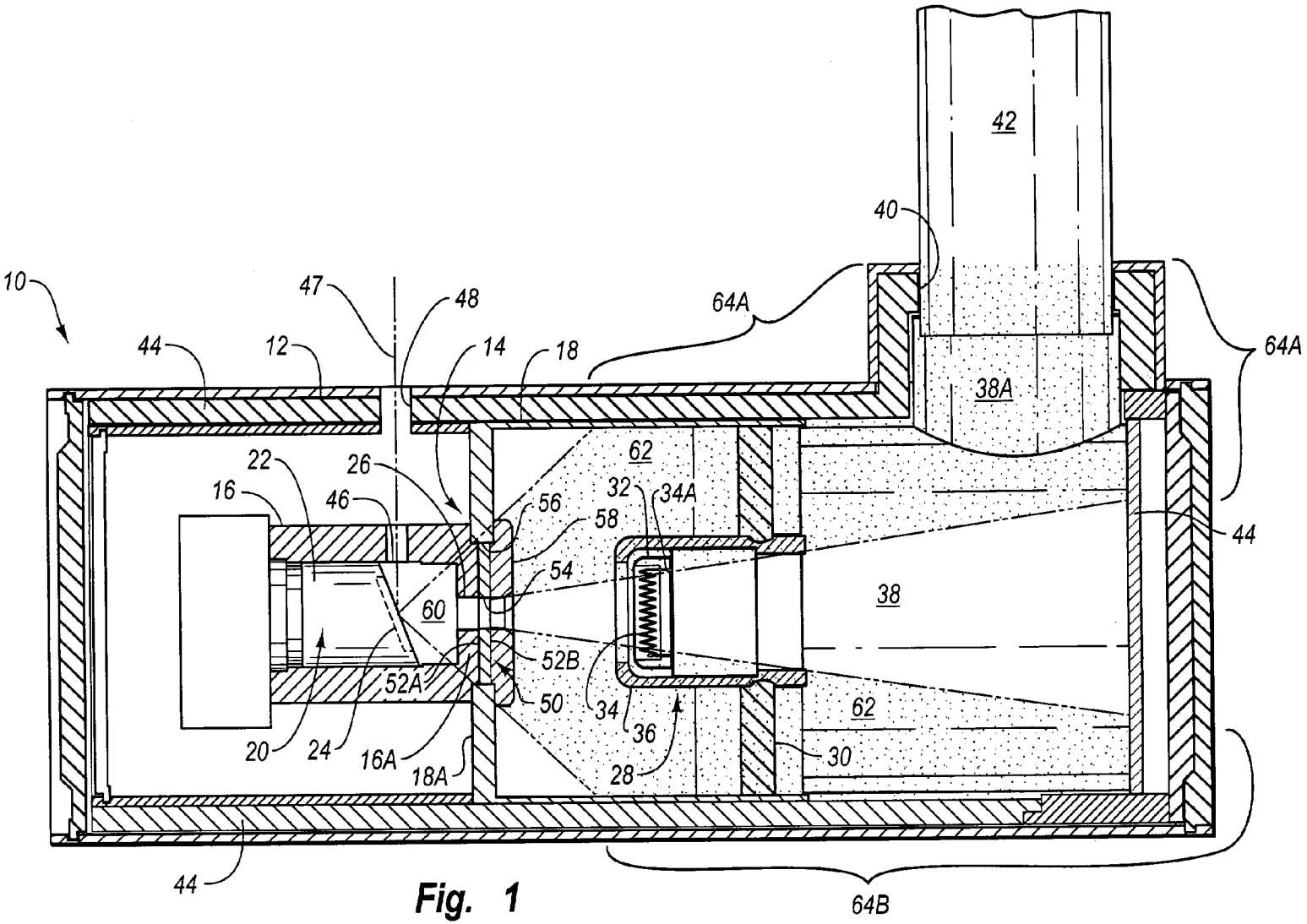
FIG. 1 is a simplified, partial cross sectional view of an x-ray tube in accordance with one embodiment of the present invention.

Reference is first made to FIG. 1, which depicts an exemplary stationary anode x-ray tube, generally depicted at 10. As shown, the x-ray tube 10 includes an outer housing 12 for containing the other components of the tube. An evacuated enclosure 14, disposed within the outer housing 12, is formed of an anode housing 16 and a cylindrical portion, referred to herein as a can 18. The anode housing 16 and can 18 are hermetically joined as to maintain a vacuum therein. The anode housing 16 is formed of a heat conductive material, such as copper or copper alloy, and houses an anode 20, including a substrate 22 and a target surface 24 disposed atop the substrate.

In contrast to rotary anode x-ray tubes, the anode 20 of the illustrated x-ray tube 10 is a stationary anode. The target surface 24 comprises a material having a sufficiently high "Z" number, such as rhodium, palladium, or tungsten, which is suitable for producing x-rays when impinged by electrons. The target surface 24 is partially oriented toward a passage 26 defined between the anode housing 16 and the can 18. The passage 26 establishes communication between the volumes enclosed by the anode housing 16 and the can 18.

The can 18 preferably comprises stainless steel and contains a cathode assembly 28 that is supported within the can by an insulating structure 30. The cathode assembly 28 includes a cathode head 32 having a slot in which an electron source, such as a filament 34, is positioned. A cathode shield 36 can be placed around the cathode head 32 to improve its high voltage characteristics.

A high voltage connector 38 is shown electrically attached to one end of the cathode assembly 28. The high voltage connector 38 includes an extension portion 38A that extends through a port 40 defined in the outer housing 12 of the x-ray tube 10. The extension portion 38A couples with a high voltage cable 42 that is connected to a voltage source (not shown) for providing a high voltage signal to the cathode assembly 28. In addition, the high voltage connector 38 and cable 42 provide an electrical signal to the filament 34 to enable it to produce electrons during tube operation.

As shown in FIG. 1, the port 40 defined in the outer housing 12 is shaped as to receive the high voltage connector extension portion 38A and a portion of the high voltage cable 42. The outer housing 12, which includes the port 40, can include a layer of lead shielding 44 for preventing x-ray emission from the x-ray tube 10. This lead shielding layer 44 is typically disposed on the inner surface of the outer housing 12. As will be discussed, the use of the lead shielding layer 44 about outer portions of the x-ray tube 10 is minimized due to the ability of the invention to absorb a significant amount of x-rays within the evacuated enclosure 14 before they reach the outer housing 12 of the tube.

In accordance with embodiments of the present invention, FIG. 1 further illustrates a radiation shield component interposed at the interface of the anode housing 16 and the can 18. As will be described, the radiation shield component in the illustrated embodiment comprises a shielding disk 50 that, as will be seen, is positioned to prevent undesired x-ray emissions from the tube 10. Further details concerning the shielding disk 50 are given below.

As evidenced by the disclosure herein, embodiments of the shielding disk comprise exemplary structural implementations of a means for reducing the number of x-rays passing from a second segment to a first segment of an evacuated enclosure. Accordingly, the scope of the invention is not limited to the disclosed exemplary structures. Instead, the scope of the invention broadly embraces any structure(s) capable of implementing the shielding disk functionalities disclosed herein. Consistent with the foregoing, exemplary embodiments of the aforementioned means are not limited solely to reducing x-rays but may implement other functionalities as well.

Briefly, when operation of the x-ray tube 10 commences, an electrical current is supplied to the filament 34 via the connector 38, which causes a beam of electrons to be emitted from the filament by way of thermionic emission. A high voltage differential is applied between the cathode assembly 28 and the anode 20 by biasing the cathode assembly with a high voltage potential provided by a voltage source (not shown) via the cable 42 and the connector 38. The high voltage differential causes the electrons emitted by the filament 34 to pass through the passage 26 and accelerate toward the target surface 24 of the anode 20, which is held at ground potential. Upon impacting the target surface 24, the kinetic energy of some of the electrons is converted to electromagnetic radiation of very high frequency, i.e., x-rays. A portion of the x-rays so produced emanate in a desired direction, indicated at 47, to pass through a window 46 defined in the anode housing 16 and exit through an aperture 48 defined in the outer housing 12. The beam of x-rays exiting the aperture 48 can be used for a variety of applications, including x-ray imaging and materials analysis.

It is noted that the x-ray tube 10 depicted in FIG. 1 comprises a side window, stationary anode, anode-grounded tube. While the principles discussed herein principally apply to such tubes, the present invention is not so limited. Indeed, the teachings herein can be applied to x-ray tubes having configurations that vary from that depicted in the accompanying drawings, such as end window stationary and rotary anode x-ray tubes, as appreciated by one skilled in the art. Further, anode grounded, cathode grounded, or double ended x-ray tubes can also utilize the present invention.

Figure 2C:
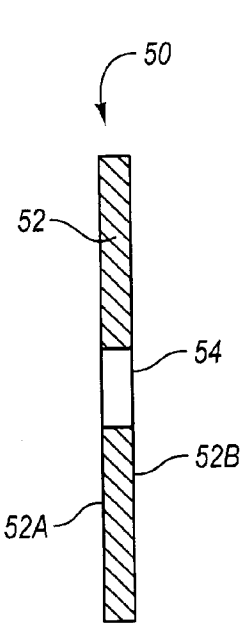
FIG. 2C is a cross sectional view of the radiation shield taken at lines 2C-2C in FIG. 2B.
Figure 2B:
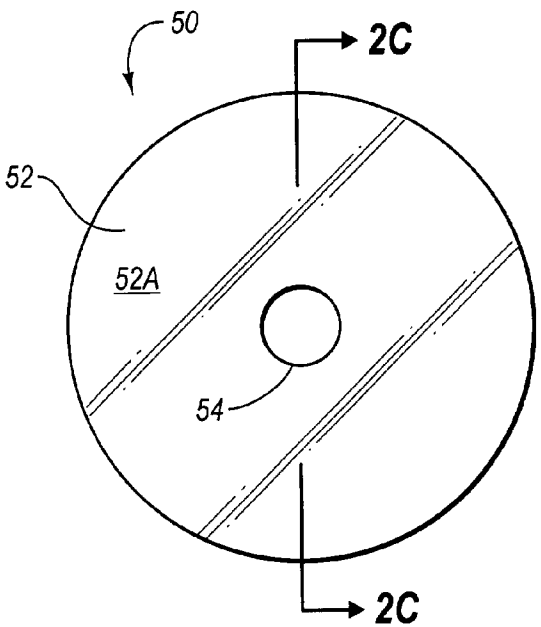
FIG. 2B is a top view of the radiation shield of FIG. 2A.
Figure 2A:
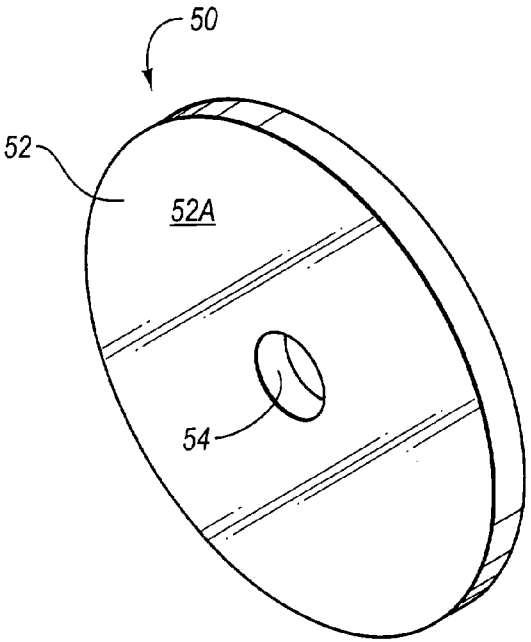
FIG. 2A is a perspective view of a radiation shield configured in accordance with one embodiment of the present invention.

Reference is now made to FIGS. 2A, 2B, and 2C, which respectively depict perspective, top, and cross sectional views of the shielding disk 50 referred to above. As mentioned, the shielding disk 50 is interposed between the anode housing 16 and the can 18 as one means for reducing the number of x-rays that pass from the anode housing to the can of the evacuated enclosure 14, thereby reducing or preventing undesired x-ray emissions from the x-ray tube 10. To do this, the shielding disk 50 possesses a shape and composition that enables it to absorb specified x-rays that emanate from the target surface 24, as will be explained.

In presently preferred embodiments, the shielding disk 50 comprises a disk-shaped body 52 having a region defined through a central portion thereof. In one embodiment, this region is fashioned as a hole 54, which cooperates with other structures in the x-ray tube 10 to define the passage 26 described above when the shielding disk 50 is positioned within the tube. It will be appreciated that this region could alternatively be configured with different geometric shapes, depending on the needs of a particular implantation.

The material from which the shielding disk 50 is composed should meet several requirements. First, the material should possess a high-Z number such that it can effectively absorb x-rays. Second, the material should possess sufficient thermal stability, which allows it to be subjected to high temperatures without degradation. Also, the material should be sufficiently pure in its desired composition so as to avoid the presence of unwanted potential contaminants that could compromise the vacuum of the evacuated enclosure 14 through outgassing or other means. In one embodiment, the shielding disk 50 is composed of tungsten. Though tungsten is preferred for its thermal stability and x-ray absorption properties, other materials could also be employed to form the shielding disk 50. Examples of alternative materials that could be acceptably used include other high-Z number materials such as molybdenum, niobium, and zirconium.

The thickness of the shielding disk 50 must be sufficient to substantially prevent the transmission of x-rays incident upon its face. Consequently, the shielding disk thickness depends on both the energy of the x-rays (determined by the power of the tube in operating voltage) that will impinge upon the disk, and the type of material comprising the disk. When disposed in an x-ray tube having an operating voltage of 180 kilovolts ("kV"), for instance, a shielding disk that is comprised of tungsten can comprise a thickness of approximately 0.32 centimeters (cm) ($1/8^{th}$ inch). Generally speaking, dense disk materials, such as tungsten, can enable a relatively thin shielding disk to be used in absorbing x-rays of a given energy, while relatively less dense materials, such as molybdenum, must be employed in greater thicknesses to absorb x-rays of the same energy.

The other dimensional characteristics of the shielding disk 50 can vary according to the particular characteristics of the x-ray tube in which the shielding disk is employed. In FIG. 1, for example, the shielding disk 50 comprising tungsten and having a thickness of approximately 0.32 cm ($1/8^{th}$ inch), as above, possesses a diameter of approximately 3.8 cm (1.5 inches), while the hole is approximately 0.95 cm ($3/8^{ths}$ of an inch) in diameter. As with the disk thickness, the other dimensions of the shielding disk can also vary based on several factors, including the tube operating voltage, the proximity of the shielding disk to the target surface, physical dimensions of the tube, etc.

The shielding disk 50 can be manufactured using any one of a variety of methods. In one embodiment, the shielding disk 50 is machined to the specifications outlined above from a mass of suitable material. In other embodiments, hot isostatic press ("HIP") and sintering methods can be employed to form a shielding disk having a composite shielding material composition. For instance, using the HIP method, a shielding disk can be manufactured by first filling an appropriately sized mold with a tungsten and copper powder mixture. The powder-filled mold is then placed in an oven where it is subjected to high temperature and pressure for a specified amount of time. The high pressure and heat environment of the oven solidifies the powder composition, increasing its density while also reducing its porosity. Once the HIP process is complete, the piece is removed from the mold and final finishing steps, if needed, are performed to complete production of the shielding disk. A shielding disk produced by the HIP method above yields a disk having a tungsten-copper matrix composition that contains the desired shielding characteristics sufficient for its use in absorbing x-rays within the evacuated enclosure of the x-ray tube 10 during operation, as will be seen further below.

As mentioned, sintering can also be used in manufacturing the shielding disk 50. In a sintering process, tungsten, nickel, and iron powders of specified proportions are mixed then subjected to solid and/or liquid phase sintering to form a mass of matrix material. The matrix material can then be formed or shaped as needed to yield the shielding disk. Similar to the HIP method, a shielding disk produced by sintering comprises a tungsten-nickel-iron matrix composition that is configured to absorb x-rays incident upon it when placed within the evacuated enclosure of the x-ray tube 10. Further details concerning the HIP and sintering methods above as applied to the manufacture of x-ray tube components can be found in U.S. application Ser. No. 09/694,568, now U.S. Pat. No. 6,749,337, entitled "X-Ray Tube and Method of Manufacture," filed Oct. 23, 2000, which is incorporated herein by reference in its entirety.

Reference is again made to FIG. 1 in describing various details regarding the placement and operation of the shielding disk 50 shown in FIGS. 2A-2C. As already described, the shielding disk 50 is positioned at the interface between the anode housing 16 and the can 18 that together define the evacuated enclosure 14. In particular, the shielding disk 50 is positioned within an aperture 56 defined in a disk-shaped base 18A of the can 18 such that an end portion 16A of the anode housing 16 is adjacent a first face 52A of the body 52 of the disk. In addition, a copper plate 58 is positioned adjacent a second face 52B of the shielding disk body 52. In this configuration, the shielding disk 50 is desirably positioned to intercept and absorb a maximized amount of x-rays emanating from the target surface 24 toward the can 18, as described further below. The anode housing end portion 16A, the shielding disk hole 54, and the plate 58 cooperate to define the passage 26 that enables electrons produced at the filament 34 to pass to the target surface 24 during tube operation. It is noted that the end portion 16A and the plate 58 are preferably comprised of copper, which possesses a high thermal conductivity, to facilitate the dissipation of heat from tube components during tube operation.

In the illustrated positional configuration described above and shown in FIG. 1, the shielding disk 50 is secured in a friction fit arrangement between the end portion 16A of the anode housing 16 and the plate 58. One or both of the end portion 16A and the plate 58 are then brazed or otherwise secured to the base 18A of the can 18 about the periphery of the can aperture 56. Alternatively, the shielding disk 50 can be directly affixed to a portion of the can 18, or can be attached using one of various other possible configurations.

Continuing reference to FIG. 1 is made in describing the operation of the shielding disk 50 described above. As stated, the shielding disk 50 is configured to absorb selected x-rays that do not emanate from the target surface 24 toward the window 46, but rather emanate in other, undesired directions within the tube. As already described, the impingement of electrons from the filament 34 on the target surface 24 of the anode 20 causes a plurality of x-rays to be continually produced at the target surface during operation of the x-ray tube 10. These x-rays radially emanate in a plurality of linear directions from the target surface 24. Those that emanate into the target surface 24 or anode substrate 22 are promptly absorbed and are not problematic. X-rays that do not travel into the anode structure, however, radially emanate from the target surface 24 in a plurality of linear directions into the vacuum surrounding the target surface 24. Many of these emanating x-rays have directions that can cause them to penetrate evacuated enclosure 14 and interact with a portion of the outer housing 12 where sufficient shielding is difficult to achieve, such as the port 40 of the housing. As already mentioned, if sufficient shielding is not in place, these x-rays can escape from the x-ray tube 10 and represent a significant source of x-ray contamination.

In accordance with embodiments of the present invention, the shielding disk 50 is configured to prevent the x-ray contamination discussed above. Additionally, the shielding disk 50 reduces the amount of lead shielding that must be included on the outer housing 12. The shielding disk 50, positioned as shown in FIG. 1 between the anode housing 16 and the can 18, is disposed to intercept a significant amount of x-rays that emanate toward the can 18 from the target surface 24. Specifically, the shielding disk 50 intercepts a conically shaped volume of x-rays emanating from the target surface 24. This volume of emanating x-rays is depicted at 60. While a portion of the x-ray volume 60 emanates through the passage 26 and is therefore unaffected by the shielding disk 50, the rest of the x-rays in the volume are intercepted by the shielding disk and are absorbed thereby. This prevents the x-rays from proceeding along their individual paths and instead stops their progress at the shielding disk 50. This creates an x-ray shadow, represented by shaded regions 62, that is three dimensionally defined by a diverging, toroid-like volume extending from behind the shielding disk 50. The x-ray shadow 62 is substantially unpopulated with x-rays from the target surface 24 as a result of the x-ray absorption performed by the shielding disk 50. It can therefore be seen that the areas of the outer housing 12 that intersect with the x-ray shadow 62, such as regions 64A and 64B (shown in cross section in FIG. 1) are substantially prevented from being impinged by x-rays from the target surface 24. One of the areas falling within the x-ray shadow 62 is the port 40 of the outer housing 12. Thus the port, which previously has represented a location of the tube that has been particularly difficult to shield from emanating x-rays, is spared x-ray impingement through use of the shielding disk 50.

As a result of the reduction in x-ray impingement upon regions of the outer housing 12 residing within the x-ray shadow 62, the need for the lead shielding layer 44 in such areas is reduced or eliminated, thereby enabling the mass of the shielding layer to be correspondingly reduced or eliminated. As mentioned, this can result in significant reductions in tube weight and complexity.

The placement of the shielding disk 50 adjacent the end portion 16A of the anode housing 16 provides an added benefit in the x-ray tube 10. With the end portion 16A substantially interposed between the target surface 24 and the shielding disk 50, the shielding disk is protected from direct impingement of electrons that impact the target surface then backscatter from it. As is known, the production of x-rays using an x-ray tube is a relatively inefficient process in that many of the electrons that impact that anode target surface do not produce primary x-rays. Most of the kinetic energy that results from the impact is released in the form of heat. Also, a significant number of electrons simply rebound from the anode target surface and strike other non-target surfaces within the x-ray tube. These electrons are often referred to as "backscattered" or secondary electrons. These backscattered electrons retain a significant amount of their original kinetic energy after rebounding. As such, the backscattered electrons can impact non-target surfaces within the tube and produce secondary or off-focus x-rays. These secondary x-rays can represent an undesirable contamination of the primary x-ray stream when they are emitted along with the primary x-rays that are produced at the target surface and exit through the tube window. Further, if any of these backscattered electrons impact the tungsten shielding disk 50, they are likely to produce high energy, or "hard," x-rays that are characteristic of tungsten. These hard x-rays are more difficult to shield than softer, lower energy x-rays produced from materials such as copper. Placement of the copper end portion 16A substantially in front of the tungsten shielding disk 50 prevents most of the backscattered electrons from impacting the tungsten disk and producing undesirable hard x-rays. Instead, the backscattered electrons impact the end portion 16A and produce the less problematic x-rays characteristic of copper, which are more easily shielded from tube emission.

It is appreciated that the shielding disk 50 represents merely one possible configuration of the present invention. Accordingly, the size, shape, composition, and position of the shielding disk within the x-ray tube can be varied to suit the needs of a particular application, as appreciated by those skilled in the art. For example, in one embodiment, the shielding disk could comprise only a disk portion, such as a half-disk shape, to provide more localized x-ray shielding, if desired. These and other modifications are therefore contemplated.

Figure 3:
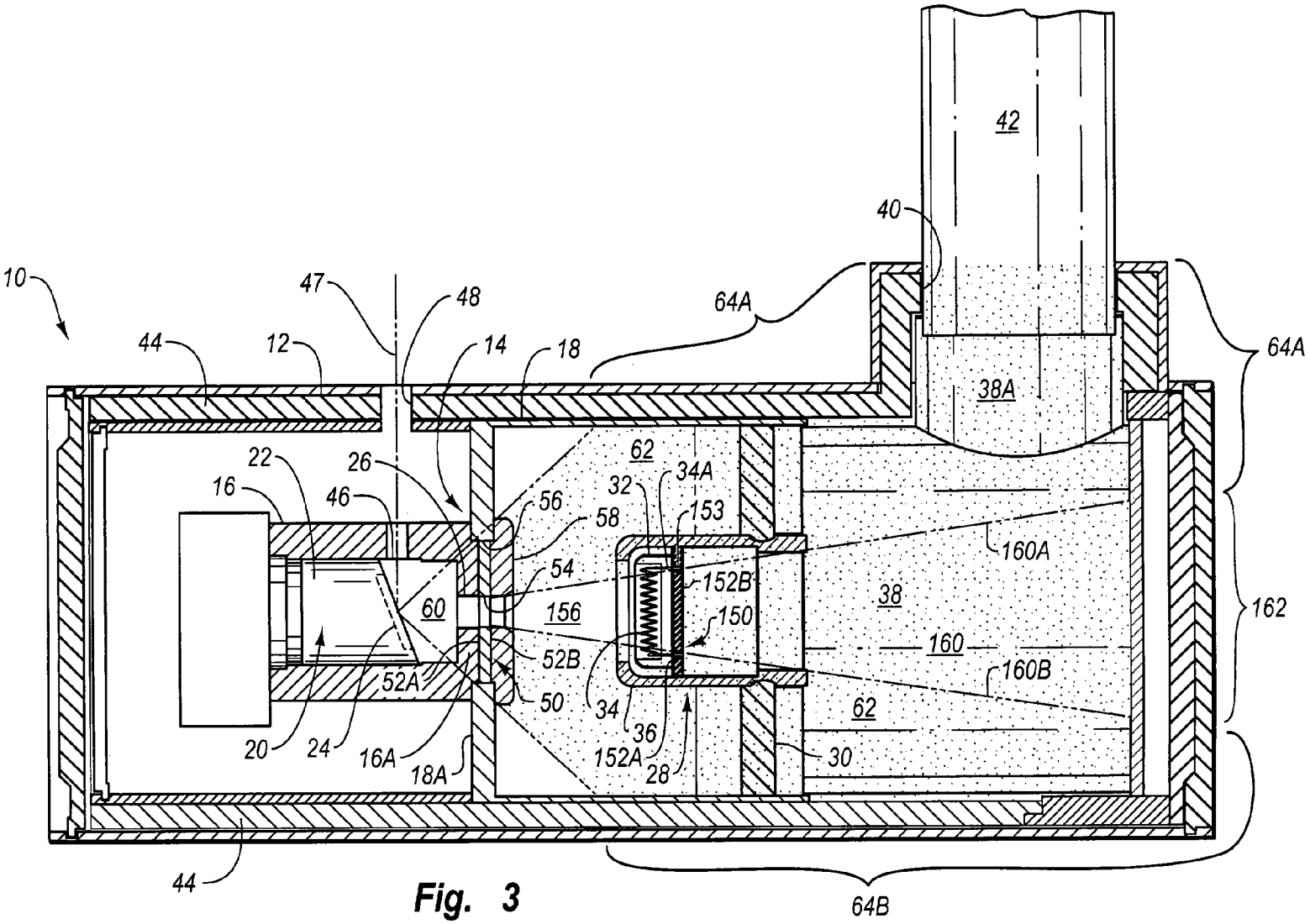
FIG. 3 is a simplified, partial cross sectional view of an x-ray tube configured in accordance with another embodiment of the present invention.
Figure 4B:
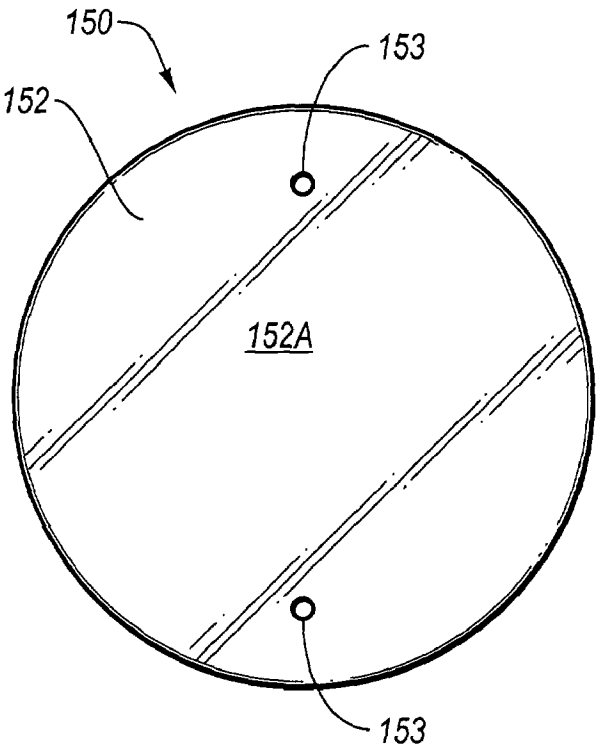
FIG. 4B is a top view of the secondary radiation shield of FIG. 4A.
Figure 4A:
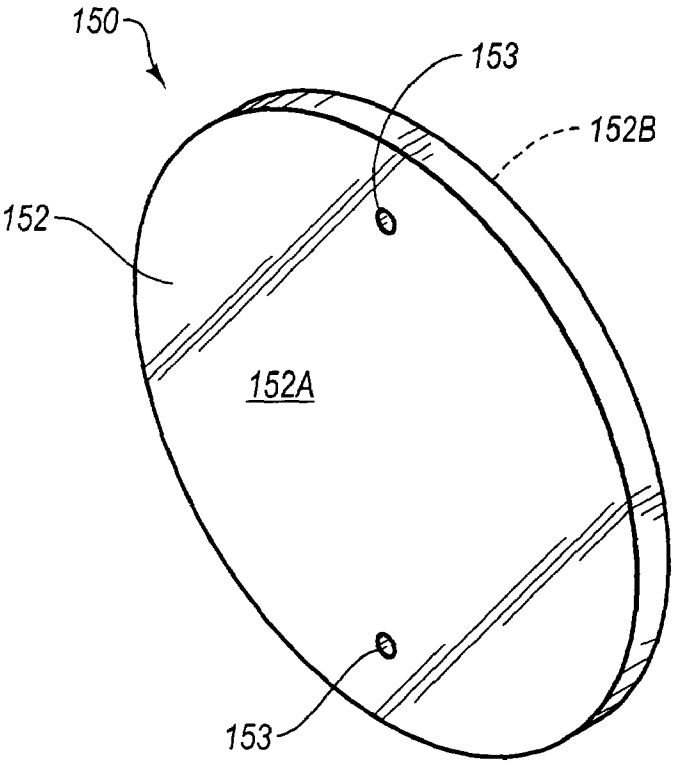
FIG. 4A is a perspective view of a secondary radiation shield configured in accordance with another embodiment of the present invention.

Reference is now made to FIGS. 3, 4A, and 4B, which together depict details regarding another embodiment of the present invention. It is noted that various similarities exist between this and the previous embodiment. As such, only selected differences will be explained in detail here. As shown in FIG. 3, a secondary radiation shielding component is disposed within the evacuated enclosure 14 of the x-ray tube 10. In the present embodiment, the secondary radiation shielding component comprises a second shielding disk 150 positioned within the cathode assembly 28 of the x-ray tube 10. As will be explained, the second shielding disk 150 is configured to cooperate with the shielding disk 50 discussed in the previous embodiment (referred to hereinafter as first shielding disk 50) in intercepting and absorbing specified portions of the x-ray stream that emanates from the target surface 24 during tube operation.

As seen in FIGS. 4A and 4B, the second shielding disk 150 in the present embodiment resembles the first shielding disk 50 in several respects. Preferably, the second shielding disk 150 comprises a disk-shaped body 152 having first and second faces 152A and 152B, respectively. Also, the second shielding disk 150 comprises an x-ray absorptive material, such as tungsten or other high-Z material. Unlike the shielding disk 50, however, the shielding disk 150 does not include a centrally located region similar to the hole 54 of the shielding disk 50. Instead, the second shielding disk 150 can feature a solid body or, as shown in FIGS. 4A and 4B, a body having two relatively small holes 153 (or similar type regions) defined therein. These holes 153 are used in the present embodiment for enabling the passage therethrough of leads for electrically connecting the filament 34 of the cathode assembly 28, as will be explained.

FIG. 3 shows the placement of the second shielding disk 150 in relation to other components of the x-ray tube 10. In particular, the second shielding disk 150 in this embodiment is positioned directly behind the cathode head 32 in the cathode assembly 28. The second shielding disk 150 is attached to the cathode head 32 or other adjacent component via any suitable attachment means, including brazing and mechanical fasteners. As shown, the second shielding disk 150 is positioned such that electrical leads 34A from the filament 34 pass through the holes 153 defined in the disk to enable electrical connection of the filament with a power supply (not shown). In this position, the second shielding disk 150 is able to carry out its intended x-ray shielding purpose while not obstructing the flow of electrons produced by the filament 34 toward the target surface 24 of the anode 20. The first shielding disk 50 is also shown in its position between the anode housing 16 and the can 18, as in the previous embodiment. During tube operation, the second shielding disk 150 works in concert with the first shielding disk 50 in reducing x-ray impingement on specified regions of the x-ray tube. In particular, the second shielding disk 150 operates to intercept and absorb at least some x-rays not effectively controlled by the first shielding disk 50. As described in connection with the previous embodiment, the shielding disk 50 creates the x-ray shadow 62 by absorbing x-rays that are incident upon its surface. However, as was also previously mentioned, some x-rays are still able to pass through the passage 26 defined between the anode housing 16 and the can 18, a region where the first shielding disk 50 is unable to intercept x-rays emanating from the target surface 24, given the hole 54 defined in the first disk. The second shielding disk 150 is configured and positioned to account for x-ray escape through the passage 26, thereby serving as a means for reducing the number of x-rays that pass through the aperture and emanate from the can 18.

In greater detail, the stream of x-rays that passes through the passage 26, depicted in FIG. 3 as the x-ray volume 156, conically diverges as it emanates through the passage and proceeds toward the cathode assembly 28. Upon reaching the cathode assembly 28, the x-rays in volume 156 are intercepted and absorbed the second shielding disk 150, substantially preventing further penetration through the x-ray tube by the x-rays. The resulting conically diverging x-ray shadow, which is depicted at 160 and defined by shadow boundary lines 160A and 160B, prevents x-rays from impacting portions of the outer housing 12, such as the region 162 at the end of the x-ray tube 10, shown in cross section in FIG. 3. It is also seen that the x-ray shadow 160 cooperates with the x-ray shadow 62 produced by the first shielding disk 50 to substantially reduce or eliminate x-ray impingement on regions of the outer housing 12 disposed beyond the cathode assembly 28.

As before, the reduction in x-ray impingement upon region 162 of the outer housing 12 reduces or eliminates the need for the lead shielding layer 44 disposed on the outer housing in region 162. This further contributes to a significant reduction in tube weight.

FIG. 3 shows the second shielding disk 150 being positioned within the x-ray tube 10, in addition to the first shielding disk 50. However, it is appreciated that the second shielding disk 150 can be utilized by itself in an x-ray tube without the first shielding disk 50, if desired. Additionally, as was the case with the first shielding disk 50, the second shielding disk 150 can be varied in its size, shape, thickness, and composition to suit the needs of a particular application. Further, though it is shown positioned in the cathode assembly 28, the second shielding disk 150 can be located in other areas within the tube 10 in order to provide specific x-ray absorption. Finally, though two shielding disks are shown in FIG. 3, the present invention contemplates the possibility that more than two shields can be disposed within the tube for effective x-ray shielding. These and other modifications of the present invention are therefore contemplated.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

The invention claimed is:

1. A stationary anode x-ray tube, comprising: an evacuated enclosure including:

a first segment containing a cathode assembly with an electron source, and the first segment defining an aperture through which electrons can pass; and a second segment hermetically joined to the first segment, the second segment containing a stationary anode having a target surface that is positioned to receive electrons produced by the electron source; and a first radiation shield at least partially disposed within the aperture defined by the first segment.

2. A stationary anode x-ray tube as defined in claim 1, wherein the first radiation shield is positioned so as to prevent the impingement of x-rays on a port defined in an outer housing containing the evacuated enclosure, the port receiving a high voltage cable that electrically connects to the cathode assembly.

3. A stationary anode x-ray tube as defined in claim 1, wherein the first radiation shield comprises a high Z material for absorbing x-rays that are incident upon it.

4. A stationary anode x-ray tube as defined in claim 1, wherein the first radiation shield defines an aperture through which the electrons pass from the electron source to the anode.

5. A stationary anode x-ray tube as defined in claim 1, further comprising a second radiation shield positioned proximate the electron source in the first segment.

6. A stationary anode x-ray tube as defined in claim 1, wherein the first radiation shield is composed of tungsten.

7. A stationary anode x-ray tube as defined in claim 1, wherein the first radiation shield is disk-shaped.

8. The stationary anode x-ray tube as defined in claim 1, wherein the first radiation shield contacts the first and second segments.

9. The stationary anode x-ray tube as defined in claim 1, further comprising a plate arranged such that the first radiation shield is positioned between the plate and the second segment, the plate defining an opening that is aligned with the passage and the aperture.

10. An x-ray tube, comprising: an evacuated enclosure comprising:

a stainless steel container containing a cathode assembly, the cathode assembly including a filament housed in a cathode head for producing and emitting electrons; and a copper anode housing hermetically joined to the stainless steel container to define a passage there between the anode housing containing a target surface disposed on a copper substrate, the target surface being positioned to receive the electrons emitted by the filament; and a first radiation shield disposed in the passage between the stainless steel container and the anode housing, the radiation shield comprising tungsten and defining a region through which the electrons from the filament can pass to the target surface.

11. An x-ray tube as defined in claim 10, wherein the first radiation shield is disk-shaped, and wherein the region is defined through a central portion of the disk 3.

12. An x-ray tube as defined in claim 11, wherein a barrier is interposed between the target surface and at least a portion of the first radiation shield so as to prevent the impingement of back scattered electrons from the target surface on the first radiation shield.

13. An x-ray tube as defined in claim 12, wherein the barrier comprises copper.

14. An x-ray tube as defined in claim 11, wherein the first radiation shield IS positioned adjacent an end portion of the copper anode housing so as to prevent the impingement of backscattered electrons from the target surface on the first radiation shield.

15. An x-ray tube as defined in claim 10, further comprising a second radiation shield positioned in a portion of the cathode assembly to absorb x-rays that pass from the target surface through the passage defined between the copper anode housing and stainless steel container.

16. An x-ray tube as defined in claim 15, wherein the second radiation shield substantially comprises tungsten.

17. An x-ray tube as defined in claim 16, wherein the second radiation shield is positioned adjacent the cathode head.

18. An x-ray tube as defined in claim 17, wherein at least one of the first and second radiation shields reduces the impingement of x-rays on a port defined in an outer housing, the outer housing containing the evacuated enclosure.

19. An x-ray tube as defined in claim 18, wherein the port receives a high voltage cable for supplying a voltage signal to the cathode assembly.

20. An x-ray tube, comprising: an evacuated enclosure comprising:

a cathode housing containing a cathode assembly, the cathode assembly including a filament housed in a cathode head;

an anode housing hermetically joined to the cathode housing and the anode housing defining an anode housing end portion, the anode housing containing a target surface that is positioned to receive electrons emitted by the filament; and a first radiation shield disposed immediately adjacent to the anode housing end portion, the first radiation shield defining an opening, wherein the opening and the anode end portion together define a passageway that allows passage of the electrons from the cathode housing to the anode housing; and a second radiation shield disposed within the cathode housing such that the filament is disposed between the first radiation shield and the second radiation shield.

21. The x-ray tube as defined in claim 20, wherein the second radiation shield is comprised of a material that includes tungsten.

22. The x-ray tube as defined in claim 20, wherein the first radiation shield is comprised of a material that includes tungsten.

23. An x-ray tube as defined in claim 20, wherein the first radiation shield reduces the impingement of x-rays on a port defined in an outer housing, the outer housing containing the evacuated enclosure.

24. An x-ray tube as defined in claim 23, wherein the port receives a high voltage cable for supplying a voltage signal to the cathode assembly.

25. The x-ray tube as defined in claim 20, wherein the first radiation shield is comprised of a material that includes copper and tungsten.

26. The x-ray tube as defined in claim 20, wherein the first radiation shield is comprised of a material that includes nickel, iron and tungsten.

27. The x-ray tube as defined in claim 20, further comprising a plate arranged such that the first radiation shield is positioned between the plate and the anode housing, the plate defining an opening that is aligned with the passage and the aperture.

28. An x-ray tube, comprising: an evacuated enclosure comprising:

a cathode housing containing a cathode assembly, the cathode assembly including a filament housed in a cathode head and the cathode housing defining an aperture that is relatively smaller than an inside diameter of the cathode housing; and an anode housing hermetically joined to the cathode housing and the anode housing defining a passage that is aligned with the aperture defined by the cathode housing, the anode housing containing a target surface that is positioned to receive electrons emitted by the filament;

a first radiation shield located proximate both the aperture defined by the cathode housing and the passage defined by the anode housing, the first radiation shield defining an opening that is aligned with the aperture, the opening defined by the first radiation shield being relatively smaller than the aperture;

a second radiation shield disposed within the cathode housing such that the filament is disposed between the first radiation shield and the second radiation shield, wherein the second radiation shield is comprised of a material that includes tungsten.

* * * * *

UNITED STATES PATENT AND TRADEMARK OFFICE

CERTIFICATE OF CORRECTION

PATENT NO. : 7,466,799 B2
APPLICATION NO. : 10/409854
DATED : December 16, 2008
INVENTOR(S) : Miller It is certified that error appears in the above-identified patent and that said Letters Patent is hereby corrected as shown below:

Column 2
Line 64, change "(weight" to --weight--

Column 12
Line 44, change "there between the" to --therebetween, the--
Line 55, change "disk 3" to --disk.--

Signed and Sealed this

Thirteenth Day of July, 2010

David J. Kappos

David J. Kappos
*Director of the United States Patent and Trademark Office*